US007084893B2

(12) United States Patent
Kato

(10) Patent No.: US 7,084,893 B2
(45) Date of Patent: Aug. 1, 2006

(54) ROLL PAPER FEEDING DEVICE AND PHOTO PRINTER

(75) Inventor: Hisahiro Kato, Daito (JP)

(73) Assignees: Funai Electric Co., Ltd., Osaka (JP); Fuji Photo Film Co., Ltd., Kanagawa-Ken (JP)

( * ) Notice: Subject to any disclaimer, the term of this patent is extended or adjusted under 35 U.S.C. 154(b) by 212 days.

(21) Appl. No.: 10/881,186

(22) Filed: Jun. 30, 2004

(65) Prior Publication Data

US 2004/0263606 A1 Dec. 30, 2004

(30) Foreign Application Priority Data

Jun. 30, 2003 (JP) ..... 2003-187621

(51) Int. Cl.
*B41J 15/00* (2006.01)

(52) U.S. Cl. ..... 347/218

(58) Field of Classification Search ..... 347/218, 347/219, 215, 171; 101/228; 400/582, 625, 400/611–614; 242/333.3, 332.2, 332.5, 170, 242/169, 348, 348.2, 348.3; 226/143, 188
See application file for complete search history.

(56) References Cited

U.S. PATENT DOCUMENTS 3,704,836 A * 12/1972 Yamada ..... 242/332.2
5,062,722 A * 11/1991 Shiozaki et al. ..... 400/582
5,477,267 A * 12/1995 Kim ..... 347/215
5,550,572 A * 8/1996 Chang et al. ..... 347/171
5,562,034 A * 10/1996 Fox ..... 101/228
5,911,380 A * 6/1999 Shiba ..... 242/348
6,622,953 B1 * 9/2003 Inana et al. ..... 242/348

FOREIGN PATENT DOCUMENTS

JP P2002-308482 A 10/2002
JP P2002-347302 A 12/2002
JP P2002-347999 A 12/2002

OTHER PUBLICATIONS

Patent Abstracts of Japan, Publication No. 2002-308482, Date of Publication: Oct. 23, 2002, 1 page.
Patent Abstracts of Japan, Publication No. 2002-347302, Date of Publication: Dec. 4, 2002, 1 page.
Patent Abstracts of Japan, Publication No. 2002-347999, Date of Publication: Dec. 4, 2002, 1 page.

* cited by examiner

*Primary Examiner*—K. Feggins
(74) *Attorney, Agent, or Firm*—Osha Liang LLP

(57) ABSTRACT

A pressing lever is attached, rotatable about one end, on a holder. The center of rotation is positioned on a side opposite to a paper feed roller with respect to the center line of a vertical slit of the holder. Further, the pressing lever is provided with a pressing bar that extends toward the holder. When a supporter is inserted to the slit of holder, a sidewall having larger diameter is brought into contact with pressing member before the shaft of supporter comes into contact with a tip end of pressing lever, and thus, pressing lever rotates smoothly.

4 Claims, 5 Drawing Sheets

ROLL PAPER FEEDING DEVICE AND PHOTO PRINTER

BACKGROUND OF THE INVENTION

1. Field of the Invention

The present invention relates to a photo printer in which an image is thermally formed on a sheet of roll paper and the image is fixed by irradiation with light of a prescribed wavelength. More specifically, the present invention relates to a roll paper feeding device of the photo printer.

2. Description of the Background Art

A photo printer employing roll paper includes a roll paper feeding device holding and feeding the roll paper, an image forming device forming an image by heating a sheet of roll paper fed from the roll paper feeding device at a prescribed temperature, an image fixing device irradiating the sheet of roll paper on which the image has been formed with ultra-violet ray to fix the image, and a cutting device cutting the sheet of roll paper on which the image has been fixed to a prescribes size to finish a photograph. In such a photo printer, roll paper is consumed as photographs are printed, and the diameter of the roll becomes smaller. Therefore, the roll paper feeding device of a conventional photo printer has such a structure as shown in FIG. 5.

FIG. 5 is a schematic diagram representing a structure of a main portion of a conventional roll paper feeding device.

As shown in FIG. 5, the conventional roll paper feeding device includes a paper feed roller 4, a holder 5, a pressing lever 6, and a sensor 8 reading information printed on a side surface of roll paper 100. The information printed on the side surface of roll paper 100 represents the type of roll paper (for example, whether it is for color printing or mono-tone printing), and based on the information, the photo printer controls various components described above.

Holder 5 is provided with an L-shaped slit 50 consisting of a vertical slit 50*a* and a horizontal slit 50*b*. Holder 5 supports a shaft 71 of a supporter 7 supporting roll paper 100, with the shaft 71 of supporter 7 axially supporting roll paper 100 being inserted through vertical slit 50*a* and fit into horizontal slit 50*b*. Shaft 71 is pressed by pressing lever 6 toward paper feed roller 4, so that supporter 7 moves toward paper feed roller 4 and roll paper 100 comes to be in contact with paper feed roller 4. Further, as holder 5 has horizontal slit 50*b* as a part of L-shaped slit 50, even when shaft 71 is pressed by pressing lever 6, the shaft abuts the inner wall of horizontal slit 50*b*, and therefore, the shaft is not raised but held movable in a prescribed direction.

A plurality of other photo printers have been proposed that include such a roll paper feeding device holding the roll paper movable in a prescribed direction (for example, in Japanese Patent Laying-Open Nos. 2002-308482, 2002-347302 and 2002-347999).

In the conventional roll paper feeding device 1 such as shown in FIG. 5, pressing fever 6 must continuously press shaft 71 of supporter 7, until fully wound roll paper 100, axially supported by supporter 7, is completely used up. For this purpose, the center of rotation of pressing lever 6 is arranged as close as possible to paper feed roller 4. It is noted, however, that sensor 8 must be mounted between the center of rotation and paper feed roller 4. Because of this positional limitation, a small sensor 8 must be used. Sensor 8 is simply for reading bar-code information printed on a side surface of roll paper 100. Therefore, considering the performance, a larger sensor, which is less expensive than a smaller one, may be used. Use of such a large sensor, however, was impossible because of the positional limitation mentioned above.

When shaft 71 of supporter 7 is mounted to slit 50, pressing lever 6 must once rotate in a direction away from paper feed roller 4. Therefore, the center of rotation of pressing lever 6 is arranged closer to paper feed roller 4 than the center line of vertical slit 50*a*. When the center of rotation of pressing lever 6 exists near the center line, it follows that the fulcrum (center of rotation), point of action (tip end) and point of force for rotating pressing lever 6 are approximately aligned in the vertical direction, and hence, for rotation, supporter 7 must be pushed with large force. This makes it difficult to load supporter 7.

When supporter 7 is to be removed from L-shaped slit 50, pressing lever 6 is detached abruptly from shaft 71 and is turned quickly back to the initial position, as the object receiving the pressing force by rotation of lever 6 is lost. This causes a large bang, and may cause damage to pressing lever 6.

SUMMARY OF THE INVENTION

An object of the present invention is to provide a photo printer including a roll paper feeding device allowing easy loading/unloading of the supporter supporting the roll paper, alleviating the positional limitation of setting the pressing lever and allowing use of a relatively large and inexpensive sensor.

The present invention provides a roll paper feeding device including a roll paper supporter supporting the roll paper, holding the roll paper supporter at a prescribed position to bring the roll paper into contact with a paper feed roller for feeding, wherein the roll paper supporter has sidewall portions formed as discs of a prescribed diameter at opposite ends in the width direction of the roll paper, and a support shaft to be inserted through the core of the roll paper. The roll paper feeding device has a holding member having an L-shaped slit allowing insertion of the support shaft from a vertical slit and holding the support shaft at a horizontal slit, and a pressing member pressing the roll paper supporter by rotation. Further, the pressing member is provided with an urging member applying an urging force for rotation in the direction to the paper feed roller. The pressing member has a first end connected as a center of rotation to a prescribed position of the holding member, and a second end is in contact with the support shaft, so that the second end rotates in the direction to the paper feed roller and presses the support shaft, because of the urging force from the urging member. Further, the pressing member is provided with a sidewall pressing member that comes to be in contact with the outer circumferential surface of the sidewall portion before the second end comes to be in contact with the support shaft when the support shaft is inserted to the vertical slit, for pressing the sidewall portion toward the paper feed roller.

Preferably, in the present invention, the center of rotation of the pressing member is positioned on the side opposite to the paper feed roller with respect to the center line of the vertical slit.

In this structure, when the roll paper supporter supporting the roll paper is inserted to the slit of the holding member, first, the outer circumferential surface of the sidewall portion having larger diameter than the shaft is brought into contact with the sidewall pressing member, so that the pressing member is rotated in a direction away from the paper feed roller. When the pressing member rotates by a prescribed amount, the tip end of the pressing member comes into contact with the support shaft. When the support shaft reaches the horizontal slit, the pressing member presses the support shaft and the sidewall portion, so that the roll paper supporter is moved toward the paper feed roller. Thus, the roll paper is held at a prescribed position, in contact with the paper feed roller. In this manner, when the roll paper supporter is loaded, first, the sidewall portion having larger diameter is brought into contact with the pressing member, and therefore the pressing member rotates gradually and the roll paper supporter can be loaded smoothly. When the roll paper supporter is to be removed, even after the pressing member is separated from the support shaft, the sidewall pressing member is still in contact with the sidewall portion having a larger diameter, and therefore, the pressing member returns gradually in smooth rotation to the initial position. Further, as the sidewall pressing member is apart from the center of rotation by a prescribed distance, there is some distance in the horizontal direction between the fulcrum and the point of action when the roll paper supporter is inserted vertically. Thus, only a little force is required for loading. Further, as the center of rotation of the pressing member is positioned away from the paper feed roller than the vertical slit, the space between the center of rotation and the paper feed roller becomes large, allowing installation of a large sensor.

More preferably, in the present invention, a V-shaped torsion spring is used at the center of rotation of the urging member, and the urging force is generated by the repulsive force of the spring.

In this structure, only the V-shaped torsion spring is used as a source of generating urging force of the urging member, and the urging member can be formed in a simple structure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The photo printer including the roll paper feeding device in accordance with an embodiment of the present invention will be described with reference to the figures.

Figure 1A:
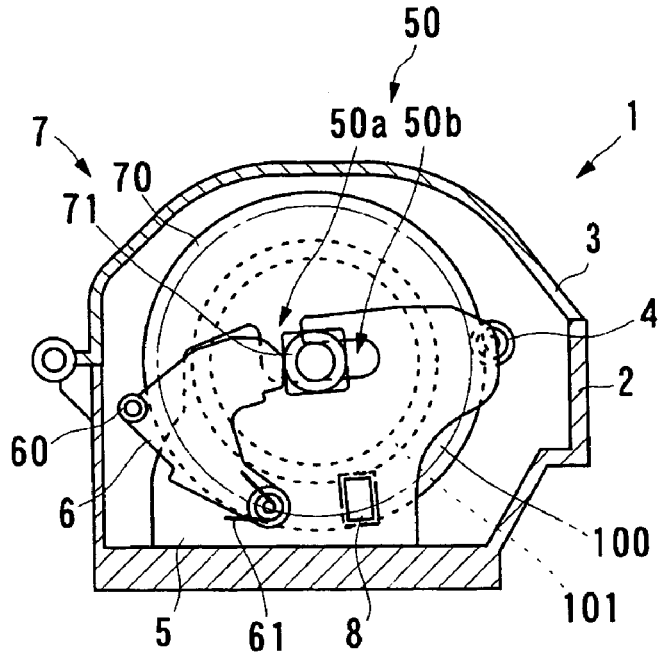
FIG. 1A is a cross sectional side view showing a main portion of the roll paper feeding device in accordance with an embodiment of the present invention.
Figure 1B:
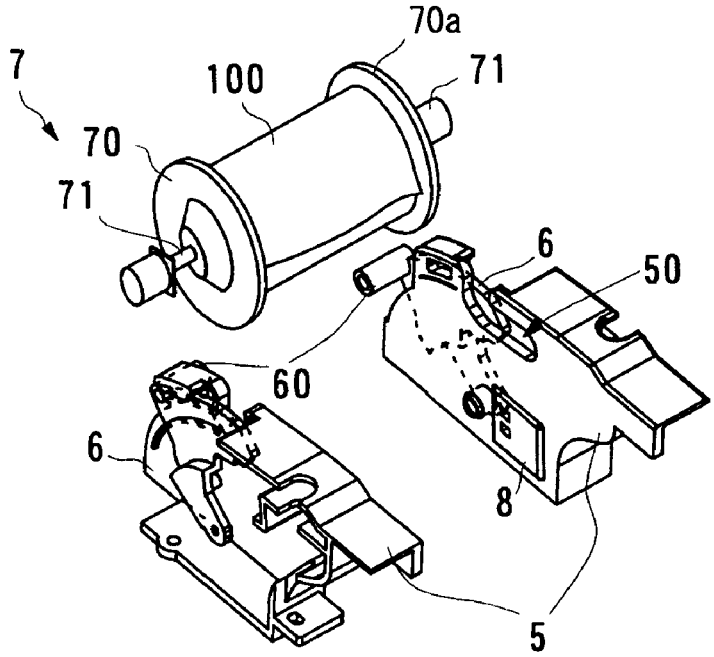
FIG. 1B is a partial perspective view showing a main portion of the roll paper feeding device in accordance with an embodiment of the present invention.

FIG. 1A is a side view and FIG. 1B is a partial perspective view, showing a main portion of the roll paper feeding device of the photo printer in accordance with the embodiment.

The roll paper feeding device 1 of the present embodiment includes a paper feed roller 4, a holder 5 corresponding to the holding member of the invention, a pressing lever 6 corresponding to the pressing member of the invention, a sensor 8, a housing 2 containing these components therein, and a cover 3 arranged at an upper portion of the housing.

Roll paper 100 is rotatably supported by a supporter 7 (corresponding to the roll paper supporter of the invention) formed to have disc shaped sidewalls 70 in contact with opposing ends in the width direction of the roll paper, and a shaft 71 inserted through the core 101 of roll paper 100. The diameter of sidewall 70 of supporter 7 is selected, by way of example, to be the same as the diameter of the roll paper having the largest diameter that can be loaded to roll paper feeding device 1, and at least one of the sidewalls 70*a* is formed of a transparent material.

Holder 5 is arranged at a position receiving the shaft 71 protruding from opposite ends of supporter 7, and has an L-shaped slit 50 to which shaft 71 is inserted and supported. L-shaped slit 50 consists of a vertical silt 50*a* for inserting shaft 71 therefrom, and a horizontal slit 50*b* movably supporting the supporter 7 in an approximately horizontal direction.

Pressing lever 6 is formed of a flat plate in a bent shape, and attached rotatable at one end to holder 5. The center of rotation is arranged at a side opposite to paper feed roller 4, with respect to the center line of vertical slit 50*a* of holder 5. Further, near the outer end of the bent portion, pressing lever 6 has a cylindrical pressing bar 60 (corresponding to the sidewall pressing member of the invention) extending to the side of holder 5. Pressing bar 60 is arranged such that its central axis is orthogonal to the flat-shaped pressing lever 6. Further, at the center of rotation of pressing lever 6, a V-shaped torsion spring 61 (corresponding to the urging member of the invention) is mounted, so as to constantly exert an urging force to paper feed roller 4.

Sensor 8 is attached to holder 5 on the side of sidewall 70*a* formed of a transparent material, and a light emitting portion and a light receiving portion of the sensor are directed to roll paper 100 and supporter 7. More specifically, the position where sensor 8 is attached is closer to paper feed roller 4 than the center of rotation of pressing lever 6 on holder 5, where the light from the light emitting portion can be reflected from the side of roll paper 100 and can be received by the light receiving portion, when the supporter 7 supporting fully wound roll paper 100 is loaded to holder 5. Sensor 8 reads the information related to the type of roll paper described above, and based on the information, a control portion, not shown, controls various portions of the photo printer.

Next, the process of loading supporter 7 supporting roll paper 100 to roll paper feeding device 1 will be described with reference to FIGS. 2A to 2D.

Figure 2A:
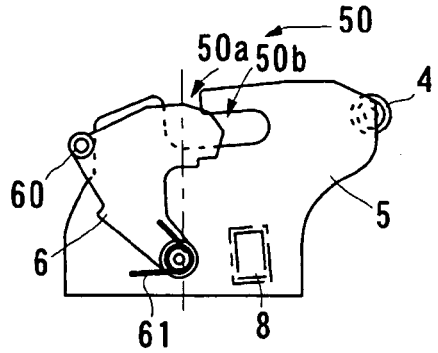
FIGS. 2A to 2D are schematic cross sections showing the steps of loading a flange to the roll paper feeding device.

FIG. 2A shows a state of holder 5 and pressing lever 6 before supporter 7 is loaded, in which pressing lever 6 is fixed at a position where pressing bar 60 is in contact with holder 5, by the urging force of V-shaped torsion spring 61 toward paper feed roller 4.

Figure 2B:
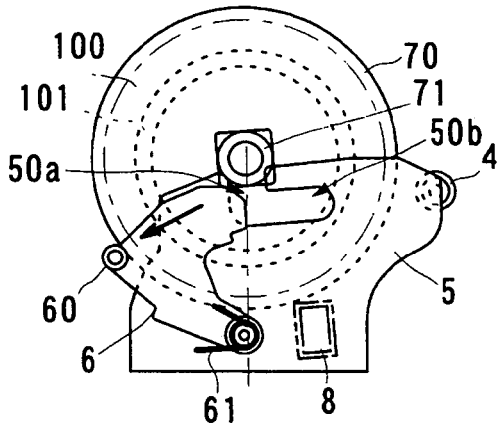
Figure 2C:
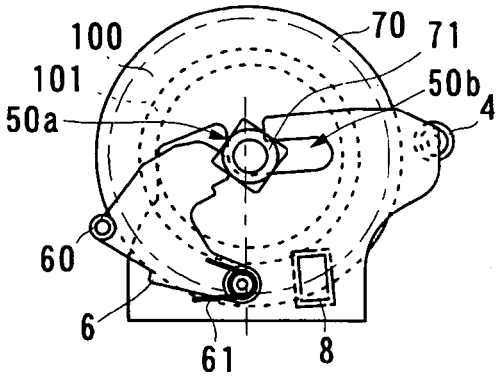

FIGS. 2B and 2C show how the shaft 71 of supporter 7 supporting roll paper 100 is inserted to vertical slit 50*a*. When the shaft 71 of supporter 70 is inserted to vertical slit 50*a*, first, sidewall 70 of supporter 7 having a large diameter comes into contact with pressing bar 60. As supporter 7 moves downward along vertical slit 50*a*, sidewall 70 presses pressing bar 60, so that pressing lever 6 rotates. Here, the direction of rotation is as represented by the arrow in FIG. 2D, and the tip end of pressing lever 6 moves away from paper feed roller 4 and slit 50. When the shaft 71 is inserted by a prescribed extent into vertical slit 50*a*, the tip end of pressing lever 6 comes to be in contact with shaft 71.

Figure 2D:
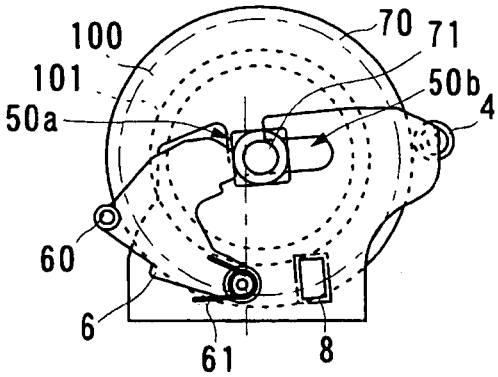

Next, as shown in FIG. 2D, when shaft 71 reaches horizontal slot 50*b*, shaft 71 moves toward paper feed roller 4 because of the pressing force from pressing lever 6 and horizontal slot 50*b*. The pressing force derives from the repulsive force of V-shaped spring 61 that received the compressing force in the previous step, which spring is arranged at the center of rotation of pressing lever 6. When roll paper 100 comes into contact with paper feed roller 4, supporter 7 supporting roll paper 100 thereon is fixed.

In this manner, as the sidewall 70 having a large diameter presses the pressing bar 60 formed at the bent portion of pressing lever 6 to cause rotation of pressing lever 6, horizontal length between the fulcrum of rotation (center of rotation) and the point of action (contact between pressing bar 60 and sidewall 70) can be made larger, without enlarging the shape of the roll paper feeding device as a whole. Therefore, when supporter 7 is inserted to slit 50 in the vertical direction, the fulcrum, point of action and point of force are not aligned, and accordingly, pressing lever 6 can be rotated without the necessity of applying a large force. In addition, because of this arrangement, it becomes unnecessary to arrange the center of rotation of pressing lever 6 closer to paper feed roller 4 than the vertical slit 50*a* as in the conventional example. This increases the degree of freedom in positioning the center of rotation of pressing lever 6. When the center of rotation is positioned as far away as possible from the paper feed roller 4 (by way of example, a position opposite to paper feed roller 4 with respect to the center line of vertical silt 50*a* as shown in the figure), the space in which sensor 8 may be attached can be enlarged. Thus, it becomes possible to use a large and inexpensive sensor 8, and as a result, roll paper feeding device 1 and the photo printer can be provided at a low cost.

Next, an operation after roll paper 100 and supporter 7 are loaded to the prescribed position will be described, with reference to FIG. 3.

Figure 3A:
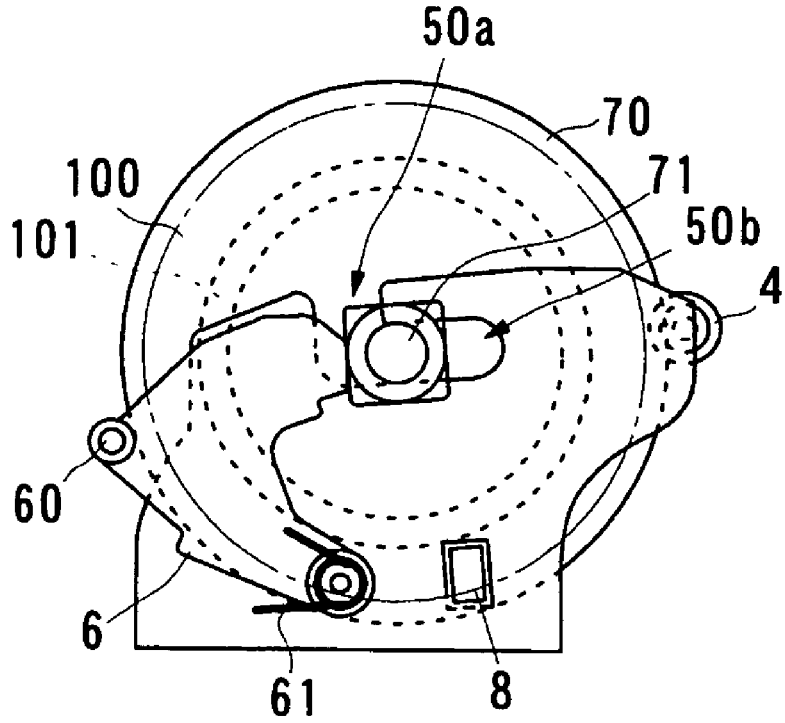
FIG. 3A is a schematic side view showing the roll paper feeding device with the roll paper fully wound.
Figure 3B:
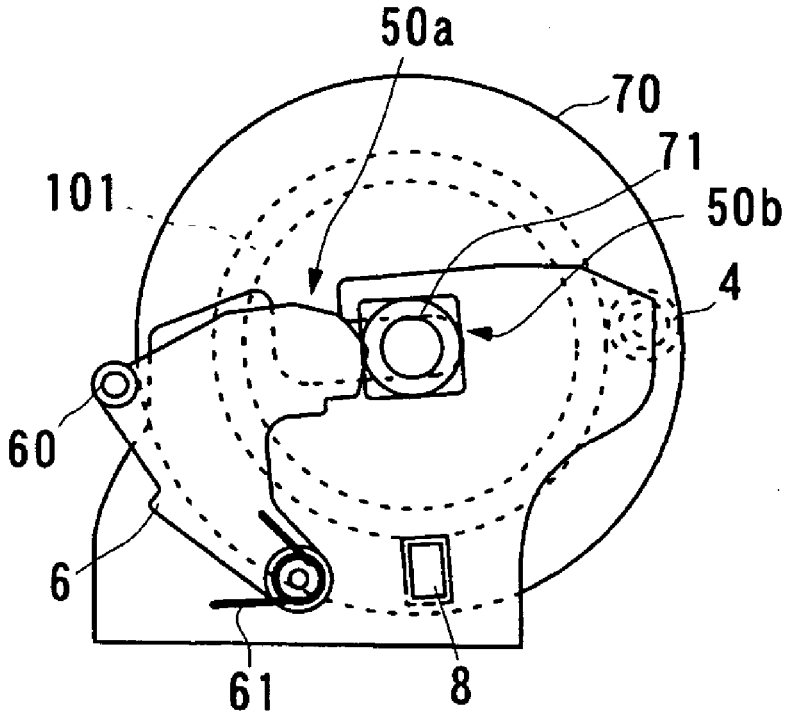
FIG. 3B is a schematic side view showing a state of the roll paper feeding device with the roll paper used up.

FIGS. 3A and 3B are schematic side views showing the states of roll paper feeding device with the roll paper fully wound and used up, respectively.

Figure 4:
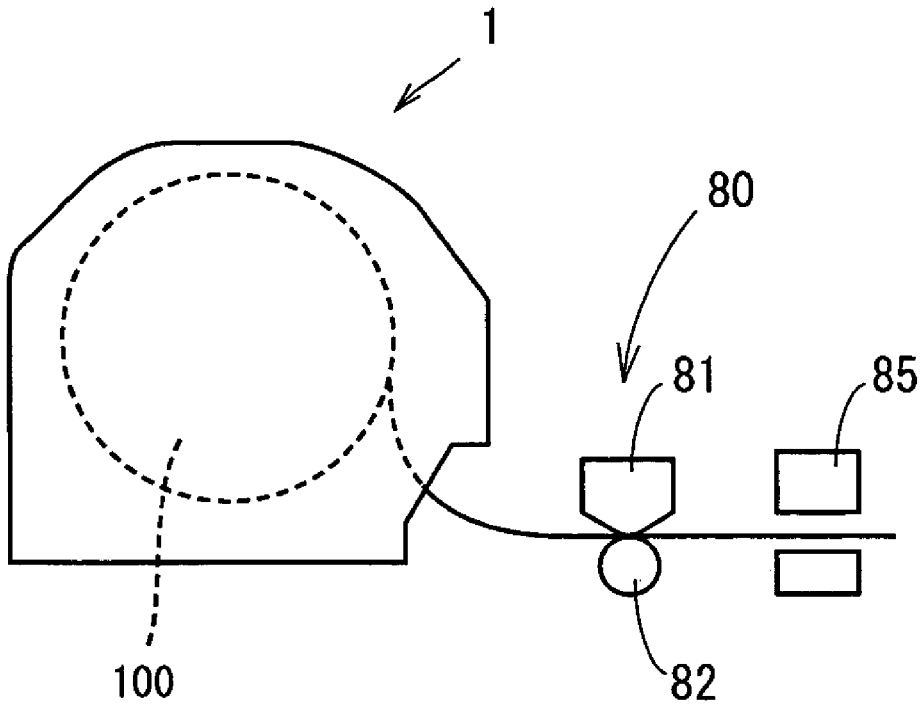
FIG. 4 is a side view showing the structure of the photo printer in accordance with and embodiment of the present invention.
Figure 5:
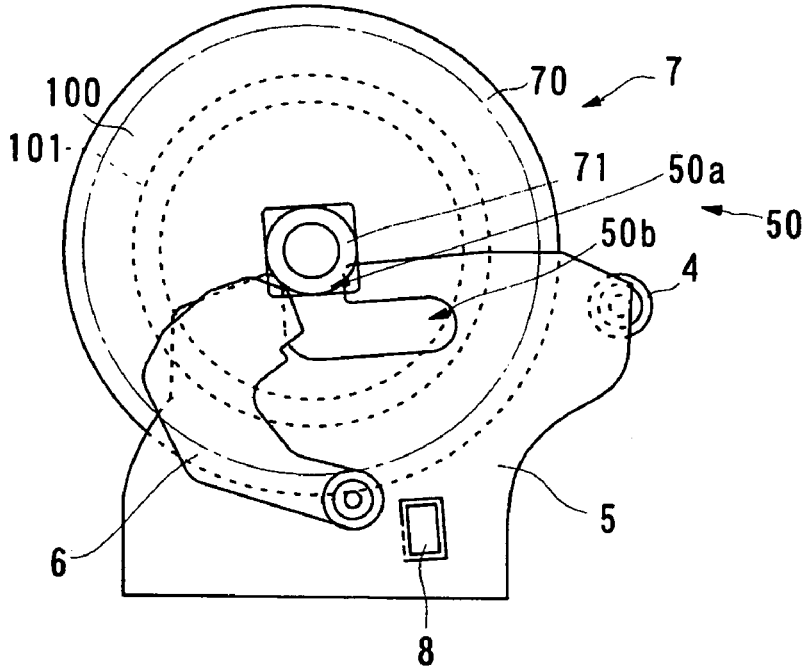
FIG.5 PRIOR ART
FIG. 5 is a side view showing a structure of a main portion of a conventional roll paper feeding device.

Referring to FIG. 3A, when fully wound roll paper 100 is loaded, paper feed roller 4 rotates in accordance with a paper feed instruction from a control portion (not shown), and feeds roll paper 100 to an image forming device 80 (see FIG. 4). Image forming device 80 includes a thermal head 81 and a platen roller 82. The fed roll paper 100 is heated in a prescribed pattern by image forming device 80, so that an image is formed thereon, and irradiated with ultra violet ray by an image fixing device 85, so that the image is fixed. The roll paper on which the image has been fixed is cut into a prescribed size, and provided as one photograph. As the photographs are continuously printed, roll paper 100 is used up, and the core 101 of roll paper 100 comes to be in contact with paper feed roller 4. All the while, supporter 7 and roll paper 100 are continuously pressed by pressing lever 6, and gradually move toward paper feed roller 4. Specifically, roll paper 100 is constantly kept in contact with paper feed roller 4 by pressing lever 6, and therefore, from the fully wound state until the paper is entirely used up, roll paper 100 can surely be fed.

When supporter 7 with empty roll paper 100 (only the core 101 is left) is to be removed from holder 5, pressing bar 60 is continuously in contact with the sidewall 70 of supporter 7, even after shaft 71 is moved away from pressing lever 6. When supporter 7 is to be pulled upward along vertical slit 50*a*, pressing lever 6 rotates gradually and returns to the initial position (the state of FIG. 2A), as pressing bar 60 and sidewall 70 are kept in contact. Thus, different from the conventional example, abrupt return of the pressing lever to the initial position can be avoided when the supporter is removed, and hence, large bang or possible damage can be prevented.

In the roll paper feeding device in accordance with the present embodiment, pressing lever 6 has a pressing bar 61 that presses the sidewall of supporter 7, so that when supporter 7 is inserted vertically to holder 5, horizontal distance between the center of rotation of the pressing lever to a contact point between sidewall 70 and pressing bar 60 can be made larger. Therefore, pressing lever 6 can be rotated by pressing the supporter with only a small force. In other words, supporter can be loaded with small force. Further, when supporter 7 is to be removed from holder 5, supporter 7 can be removed with the lever being kept in contact with sidewall 70 having a large diameter, and therefore, large bang or possible damage caused by abrupt return of pressing lever 6 to the initial position can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photo printer, comprising: a roll paper feeding device having a roll paper supporter supporting roll paper, holding the roll paper supporter at a prescribed position and bringing the roll paper into contact with a paper feed roller for feeding; an image forming device forming an image by heating the roll paper fed from the roll paper feeding device; and an image fixing device fixing said image by irradiating with light the roll paper on which the image has been formed by the image forming device; wherein said roll paper supporter includes sidewall portions formed as discs of a prescribed diameter at opposite ends in the width direction of the roll paper and a support shaft to be inserted through the core of the roll paper;

said roll paper feeding device further has a holding member having an L-shaped slit allowing insertion of said support shaft from a vertical slit and holding said support shaft at a horizontal slit, and a pressing member pressing said roll paper supporter by rotation;

said pressing member has first and second ends, said first end connected as a center of rotation to a side opposite to said paper feed roller with respect to a center line of said vertical slit of said holding member, and said second end being in contact with the support shaft;

at said center of rotation of said pressing member, an urging member formed of a V-shaped torsion spring is provided for generating an urging force for rotating said second end toward said paper feed roller, and by the urging force of said urging member, said second end rotates in a direction to the paper feed roller and presses said support shaft; and said pressing member is provides with a sidewall pressing member that comes into contact with an outer circumferential surface of said sidewall portion before said second end comes into contact with said support shaft when said support shaft is inserted to said vertical slit, for pressing said sidewall portion toward said paper feed roller.

2. A roll paper feeding device comprising a roll paper supporter supporting the roll paper, holding the roll paper supporter at a prescribed position and bringing the roll paper into contact with a paper feed roller for feeding; wherein said roll paper supporter includes sidewall portions formed as discs of a prescribed diameter provided at opposite ends in the width direction of the roll paper, and a support shaft to be inserted through the core of the roll paper;

said device further comprising a holding member having an L-shaped slit allowing insertion of said support shaft from a vertical slit and holding said support shaft at a horizontal slit, and a pressing member pressing said roll paper supporter by rotation; wherein said pressing member has first and second ends, said first end connected as a center of rotation to a prescribed position of said holding member, and said second end being in contact with said support shaft;

an urging member applying an urging force to said pressing member is provided, and by the urging force of said urging member, said second end rotates in a direction to the paper feed roller and presses said support shaft; and said pressing member is provided with a sidewall pressing member that comes into contact with an outer circumferential surface of said sidewall portion before said second end comes into contact with said support shaft when said support shaft is inserted to said vertical slit, for pressing said sidewall portion toward said paper feed roller.

3. The roll paper feeding device according to claim 2, wherein said pressing member has said center of rotation positioned on a side opposite to said paper feed roller with respect to the center line of said vertical slit.

4. The roll paper feeding device according to claim 2, wherein said urging member is formed of a V-shaped torsion spring.

* * * * *